United States Patent [19]

Sekiya et al.

[11] 4,246,602

[45] Jan. 20, 1981

[54] ELECTRONIC TIMEPIECE

[75] Inventors: Fukuo Sekiya, Tokorozawa; Takashi Yamada, Sayama, both of Japan

[73] Assignee: Citizen Watch Company Limited, Tokyo, Japan

[21] Appl. No.: 966,916

[22] Filed: Dec. 6, 1978

[30] Foreign Application Priority Data

| | | | |
|---|---|---|---|
| Dec. 9, 1977 | [JP] | Japan | 52/165534[U] |
| Dec. 9, 1977 | [JP] | Japan | 52/165535[U] |
| Dec. 10, 1977 | [JP] | Japan | 52/165860[U] |

[51] Int. Cl.[3] ..... G04C 9/00; G04B 27/00

[52] U.S. Cl. ..... 368/471; 368/187

[58] Field of Search ..... 58/4 A, 24 R, 34, 39.5, 58/23 R, 23 D, 50 R, 58, 85.5, 127 R, 126 R, 152 R

[56] References Cited

U.S. PATENT DOCUMENTS

| | | | |
|---|---|---|---|
| 3,911,665 | 10/1975 | Van Berkun | 58/50 R |
| 3,984,973 | 10/1976 | Ho | 58/50 R |
| 4,026,101 | 5/1977 | Moyer | 58/50 R |
| 4,077,032 | 2/1978 | Volkman | 58/50 R X |
| 4,110,967 | 9/1978 | Fujija | 58/23 R |
| 4,945,191 | 3/1976 | Van Berkun | 58/50 R |

*Primary Examiner*—Vit W. Miska

*Attorney, Agent, or Firm*—Jordan and Hamburg

[57] ABSTRACT

An electronic timepiece having both an electro-optical time display and time indicating hands, and means for setting both the electro-optical display and the hands to display an identical initial time value and to be thereafter advanced in synchronism with each other.

5 Claims, 2 Drawing Figures

ELECTRONIC TIMEPIECE

The present invention relates to electronic timepieces having both a digital type of time indication by an electro-optical display and an analog time indication by means of time indicating hands, and in particular to means whereby the both of said analog and digital time indicating displays can be set to identical initial value of time, and can be advanced in synchronism thereafter or can be adjusted to display different time values if required.

In recent years, electronic timepieces which display time in both analog and digital form have been developed. In such timepieces, the analog display is provided by time indicating hands, while the digital display is provided by an electro-optical display section on the timepiece dial. In such timepieces, it is normally required that both the digital and the analog displays shall indicate the same value of time. It is therefore necessary to provide some means for adjusting the analog and digital displays independently of each other, at the time of assembly in the factory or when the timepiece battery is replaced in a shop. Subsequently, it is usually necessary to provide some means whereby the timepiece user can correct the time indicated by both the analog and digital displays, without introducing any discrepancy between the values indicated by both displays.

With an electronic timepiece in accordance with the present invention, the above objectives can be easily and economically attained. It is moreover possible to provide an electronic timepiece whereby the analog or the digital display can be independently set by the timepiece user to indicate the current time in some distant region, i.e. one display can indicate the local time while the other display indicates the time at the distant region.

It is therefore an object of the present invention to provide an improved type of electronic timepiece having both an analog and a digital time display.

More particularly, it is an object of the present invention to provide an improved type of electronic timepiece having both an analog and a digital time display wherein said analog and digital time displays can both be set to display an identical value of time, and can thereafter be caused to both continously indicate the correct value of current time.

Further objects, features and advantages of the present invention will be made more apparent from the following description, when taken in conjunction with the attached drawings, whose scope is indicated by the appended claims.

Figure 1:
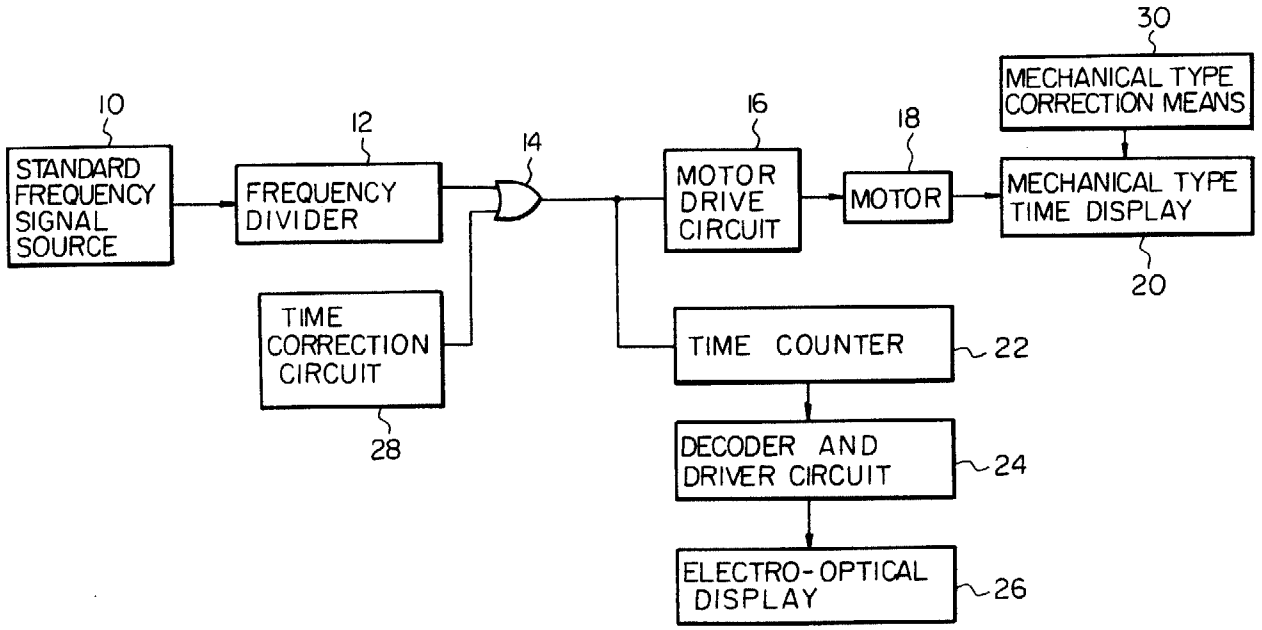
FIG. 1 is a block diagram of a first embodiment of an electronic timepiece according to the present invention.

Referring now to the drawings, FIG. 1 shows a block diagram of an electronic timepiece in accordance with a first embodiment of the present invention. The timepiece shown in FIG. 1 has a standard frequency signal supplied from a standard frequency signal source 10 such as a quartz crystal controlled oscillator circuit, which is applied to a frequency divider circuit 12. The output of frequency divider circuit 12 is a standard time signal with frequency 1 Hz, and is applied through an OR gate 14 to a motor drive circuit 16. The output of motor drive circuit 16 is applied to a stepping motor 18, which drives a mechanical type of time display 20, comprising a gear train coupled to time indicating hands, to provide an analog display of time.

The output of frequency divider 12 is also applied through OR gate 14 to a time counter circuit 22, which counts the second, minutes and hours of time and provides corresponding outputs to a decoder and driver circuit 24. Outputs from decoder and driver circuit 24 drive an electro-optical time display 26, to provide a digital display of time.

An electronic timepiece as shown in FIG. 1, having both an analog display of time by means of time indicating hands and a digital display of time by an electro-optical display, offers various advantages. For example, since the current time is available from time counter 22, and alarm function can easily be provided by electronic means, in a more convenient and economical way than is possible with a timepiece having only a mechanical type of analog time display. The analog time display by time indicating hands, however, is generally clearer and easier to read rapidly, by comparison with a digital time display.

Numeral 28 indicates a time correction circuit, used to apply correction pulses through OR gate 14 to both motor drive circuit 16 and time counter 22. Time correction circuit 28 may comprise an external actuation member coupled to a circuit for generating correction pulses when the external actuation member is actuated, or can also comprise a circuit coupled to frequency divider 12 for providing automatic time correction pulses, as is described in co-pending U.S. patent application Ser. No. 966,915 by the same applicant.

Numeral 30 indicates mechanical type correction means coupled to analog time display 20, whereby the time indicated by analog time display 20 can be adjusted to a desired value independently of electro-optical display 26.

The operation of the circuit of FIG. 1 will now be described.

When a battery is first inserted or is replaced in the timepiece, an output signal having a frequency of 1 Hz will be applied to both time counter circuit 22 and motor drive circuit 16, from OR gate 14, causing both the analog and digital displays of the timepiece to begin to advance. At this point, however, the time indicated by the timepiece hands and by the electro-optical display 26 will usually be different. Mechanical type correction means 30 must therefore be actuated so as to cause both the time indicating hands of mechanical type time display 20 and the electro-optical display 26 to indicate the same value of time. When this has been done, time correction circuit 28 can be actuated to apply correction pulses through OR gate 14 to both motor drive circuit 16 and time counter 22, so as to cause both the time indicating hands of mechanical type time display 20 and the electro-optical display 26 to indicate the correct value of current time. Thereafter, the time shown by the time indicating hands and by electro-optical display 26 will be maintained in synchronism by the output from frequency divider circuit 12 applied through OR gate 14 to both time counter 22 and motor drive circuit 16.

If desired, mechanical type correction means 30 can be made accessible to the timepiece user, so that the user can set the time indicating hands to the current time at some distant location. Thereafter, the time indicating hands will continue to display the time at said distant location, while electro-optical display 26 indicates the local time.

It is also possible to easily extend time counter 22 to provide a date display by electro-optical means, by using a days counter in addition to seconds, minutes and hours counters.

Figure 2:
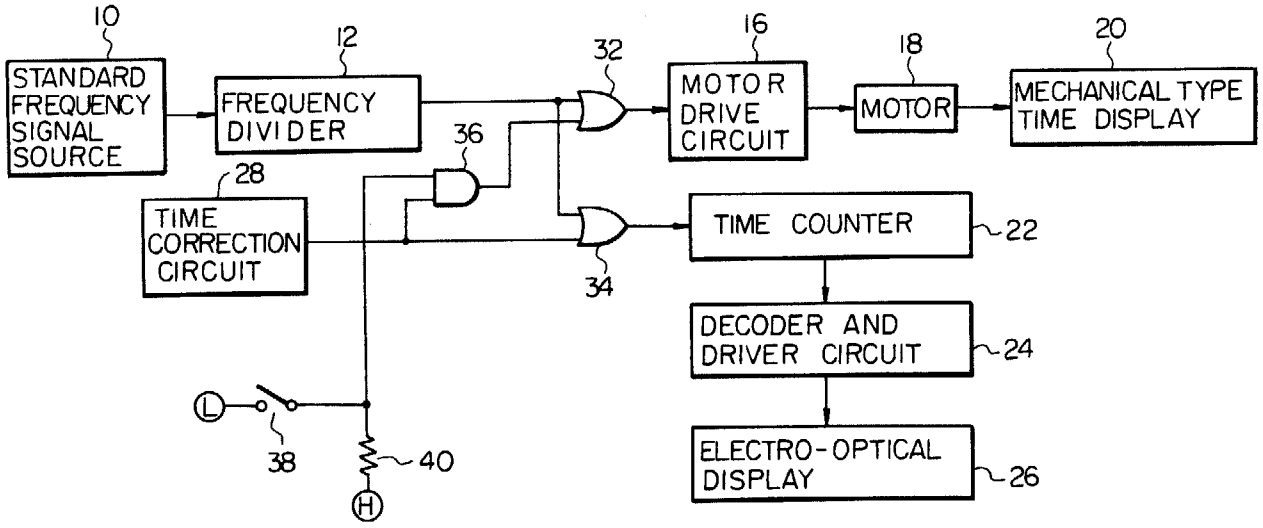
FIG. 2 is a block diagram of a second embodiment of an electronic timepiece according to the present invention; and, FIG. 3 is a block diagram of a third embodiment of an electronic timepiece according to the present invention.

Referring now to FIG. 2, a block diagram of a second embodiment of the present invention is shown therein. A standard frequency signal is supplied from a standard frequency signal source 10 to a frequency divider circuit 12, which produces a standard time signal having a frequency of 1 Hz. This standard time signal is applied through OR gate 32 to a motor drive circuit 16. The output of motor drive circuit 16 is applied to a stepping motor 18, which drives a mechanical type of time display 20. As in the case of the first embodiment of the present invention described above, mechanical time display 20 comprises a gear train coupled to time indicating hands, and provides a display of time in analog form.

The output of frequency divider 12 is also applied to time counter circuit 22, through an OR gate 34. Time counter circuit 22 counts the seconds, minutes and hours of time, and provides outputs to a decoder and driver circuit 24, which drives an electro-optical display 26 to provide a display of time in digital form.

A time correction circuit 28 generates correction pulses, when required for time correction, which are applied to one input of an AND gate 36 and to an input of OR gate 34. The output of AND gate 36 is coupled to an input of OR gate 32. One end of a resistor 40 is connected to the high potential of the timepiece battery, i.e. to the high logic level potential of the timepiece circuit. The other end of resistor 40 is connected to an input of AND gate 36, and also to a terminal of a switch 38. The other terminal of switch 38 is connected to the low logic level potential of the timepiece circuit.

The operation of the circuit is as follows. When a battery is inserted into the timepiece for the first time, or when a battery is replaced, then switch 38 is closed. This causes a low potential to be applied to the corresponding input of AND gate 36, inhibiting the gate. Correction pulses produced by correction circuit 28 can now only be applied through OR gate 34 to time counter circuit 22, but cannot be applied through OR gate 32 to motor drive circuit 16. By actuating time correction circuit, it is therefore possible to set the contents of time counter 22 so that electro-optical display 26 will display the same time value as mechanical type time display 20. When this has been done, then switch 38 is opened. This causes a high potential to be applied to the corresponding input of AND gate 36, so that the gate is enabled. If time correction pulses are now produced by time correction circuit 28, then these pulses will be applied both to motor drive circuit 16, through AND gate 36 and OR gate 32, and to time counter 22, through OR gate 34. Thus, these time correction pulses cause both the timekeeping hands of mechanical type time display 20 and the electro-optical display 26 to be advanced by the same amount, i.e. the same amount of correction is applied to both the analog and the digital time displays.

After a battery has been inserted, standard time pulses are applied from frequency divider 12 to motor drive circuit 16 and to time counter 22, through OR gate 32 and OR gate 34 respectively, irrespective of whether switch 38 is open or closed. Thus, after the contents of time counter 22 and the time displayed by the time indicating hands have been initially set to the same time value, by applying correction pulses with switch 38 closed, and have both then been set to the correct value of current time, by applying correction pulses with switch 38 opened, then both the analog and digital displays of the timepiece will continue to indicate the correct current time thereafter.

If desired, switch 38 can be made operable by the timepiece user. If this is done, then it is possible for the user to set the current time at some distant region into time counter circuit 22, by applying correction pulses from time correction circuit 28 after switch 38 has been closed. Switch 38 can then be opened, and thereafter the current local time will be indicated by mechanical type time display 20, i.e. by the time indicating hands, while the current time at the distant region will be indicated by the electro-optical display 26.

Figure 3:
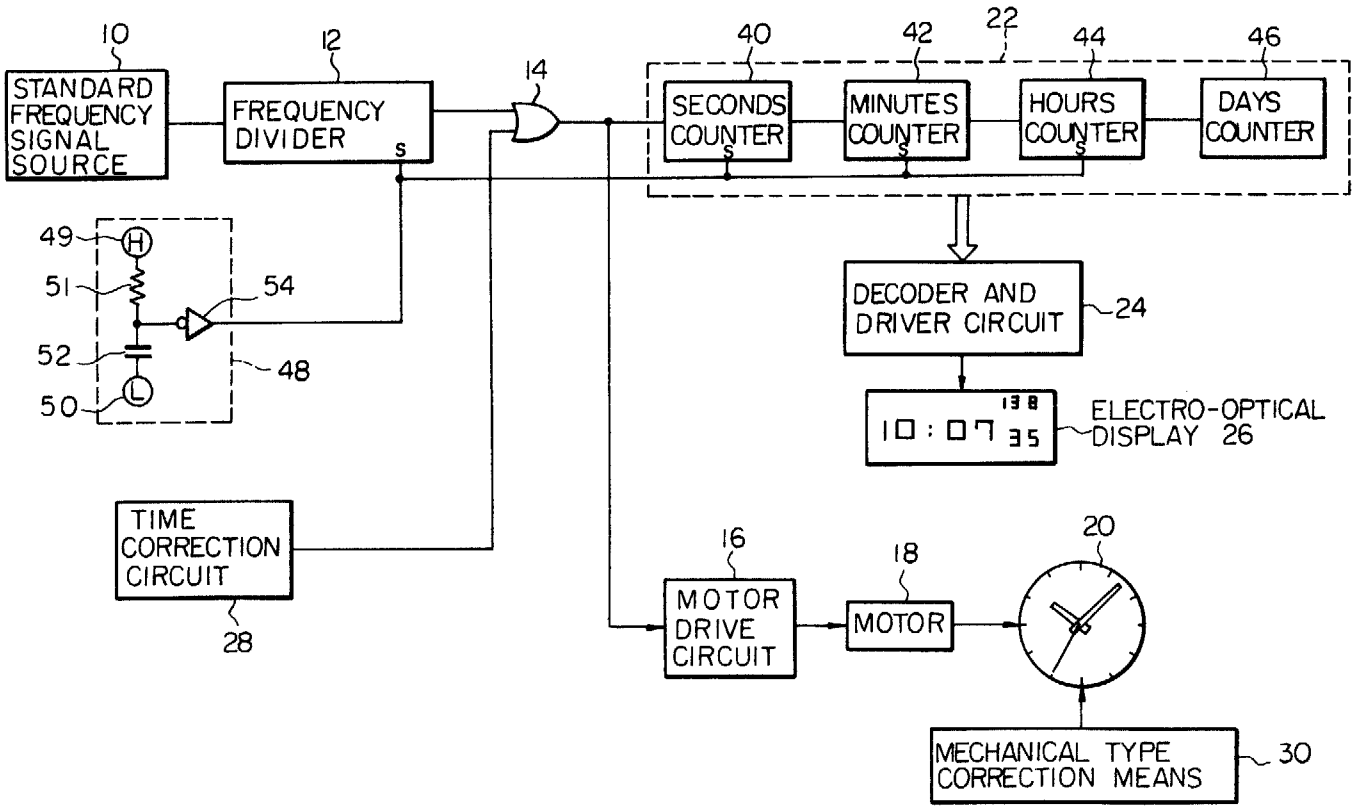

Referring now to FIG. 3, a block diagram is shown therein of a third embodiment of the present invention. A standard frequency signal is produced by standard frequency signal source 10 and is applied to a frequency divider circuit 12, which produces a standard time signal having a frequency of 1 Hz. This standard time signal is applied through an OR gate 14 to a time counter circuit 22, which contains a seconds counter 40, a minutes counter 42, an hours counter 44, and a days counter 46. The outputs of counters 40, 42, 44 and 46 are applied to a decoder and driver circuit 24 which drives an electro-optical display 26.

The standard time signal from frequency divider 12 is also applied through OR gate 14 to motor drive circuit 16, the output of which drives a stepping motor 18, coupled to a mechanical type time display 20 having time indicating hands. Time correction pulses which are generated by time correction circuit 28 when required, are applied to both time counter circuit 22 and to motor drive circuit 16 through OR gate 14. Mechanical type correction means 30 are coupled to mechanical type time display 20 so that the time indicating hands of display 20 can be set to a desired value of time, independently of electro-optical display 26.

Numeral 48 indicates a circuit used for automatic reset of the contents of time counter 22 when a battery is inserted into the timepiece. Numerals 49 and 50 indicate terminals which become connected to the high potential and low potential terminals of the battery respectively, when a battery is inserted. One end of a resistor 51 is connected to terminal 49, and the other end of resistor 51 is connected to an input of an inverter 54 and also to one terminal of a capacitor 52. The other terminal of capacitor 52 is connected to terminal 50. The output of inverter 54 is coupled to set terminals of final stages of frequency divider circuit 12, seconds counter 40, minutes counter 42, and hours counter 44.

The operation of this circuit is as follows. When a battery is first inserted into the timepiece, or when a battery is replaced, then capacitor 52 will initially be in an uncharged state, so that a low potential will be applied to the input of inverter 54. The output of inverter 54 is therefore at the high potential level, causing the final stages of frequency divider 12, and the seconds counter 40, minutes counter 42 and hours counter 44 to become set to some predetermined value of time. As capacitor 52 becomes charged by current flowing through resistor 51, the voltage across capacitor 52 will rise to reach the high potential level, causing the output of inverter 54 to go to the low potential level. Frequency divider 12, and seconds counter 40, minutes counter 42 and hours counter 44 will thereafter begin to count in accordance with the standard frequency signal applied to frequency divider 12, starting from said predetermined value of time as an initial value. Prior to inserting a battery into the timepiece, time display 20 is set to said predetermined value of time, by actuating mechanical type correction means 30. Thus, when a battery is inserted, no output will be produced by frequency divider 12 until the set condition of the final stages of frequency divider 12 is released, i.e. until the output of inverter 54 falls to the low potential level. This can only occur after time counter 22 seconds counter 40, minutes counter 42 and hours counter 44 have been set to the predetermined time value. The time indicated by electro-optical display 26 and by mechanical type time display 20 will therefore be identical, immediately after a battery is inserted, and the times indicated by displays 20 and 26 will remain synchronized thereafter, since both displays are advanced by the standard time signal which is output from OR gate 14.

Such an arrangement obviously presents several advantages from the viewpoint of large scale production of electronic timepieces having both time indicating hands and electro-optical display. It is only necessary to adjust the time indicating hands of each timepiece to some predetermined value, for example 12:00, prior to inserting a battery, to ensure that the analog and digital displays will be synchronized to precisely the same time. This is highly suitable for modern automated production techniques, and will enable manufacture of such timepieces to be implemented in a more economical way than has heretofore been possible.

If required, mechanical type time correction means 30 can be made operable by the timepiece user, so that the time indicating hands can be set to some desired value independently of electro-optical display 26. The current time at some distant region can thus be set to be indicated by the time indicating hands of display 20, while the current local time is indicated by electro-optical display 26.

Although the present invention has been shown and described with respect to particular embodiments, various modifications to these embodiments are possible, which come within the scope claimed for the present invention.

What is claimed is:

1. An electronic timepiece powered by a battery, comprising:

a source of a standard time signal;

electro-optical display means for displaying at least the minutes and hours of time;

electronic counter means responsive to said standard time signal for counting at least the minutes and hours of time, and having an output coupled to said electro-optical display means;

time indicating hands;

a motor for rotating said time indicating hands;

motor drive circuit means responsive to said standard time signal for driving said motor to cause said time indicating hands to indicate at least the minutes and hours of time;

first correction means for enabling one of said electro-optical display means and said time indicating hands to be set to indicate a desired value of time independently of the other one of said electro-optical display means and said time indicating hands; and, second correction means for enabling both said electro-optical display means and said time indicating hands to be set to indicate a desired value of time substantially simultaneously.

2. An electronic timepiece according to claim 1, wherein said first correction means comprises mechanical type correction means coupled mechanically to said time indicating hands, to enable said time indicating hands to be rotated to indicate a desired time value, and wherein said second correction means comprises time correction circuit means for producing time correction pulses and OR gate means, said OR gate means having an input terminal coupled to receive said time correction pulses and another input terminal coupled to receive said standard time signal and having an output terminal coupled to an input terminal of said motor drive circuit means and to an input terminal of said electronic counter means.

3. An electronic timepiece according to claim 1, and further comprising setting circuit means for automatically setting said electronic counter means to a predetermined value of time when a battery is inserted.

4. An electronic timepiece according to claim 3, wherein said setting circuit means comprises a resistor having one terminal coupled to one terminal of said battery, a capacitor having one terminal connected to another terminal of said battery and having another terminal connected to the other terminal of said resistor, and an inverter having an input terminal connected to the junction of said capacitor and said resistor and an output terminal connected to set terminals of said electronic counter means.

5. An electronic timepiece powered by a battery, comprising:

a source of a standard time signal;

electro-optical display means for displaying at least the minutes and hours of time;

electronic counter means responsive to said standard time signal for counting at least the minutes and hours of time, and having an output coupled to said electro-optical display means;

time indicating hands;

a motor for rotating said time indicating hands;

motor drive circuit means responsive to said standard time signal for driving said motor to cause said time indicating hands to indicate at least the minutes and hours of time; and correction means for enabling one of said electro-optical display means and said time indicating hands to be set to indicate a desired value of time independently of the other one of said electro-optical display means and said time indicating hands;

said correction means comprising time correction circuit means for producing time correction pulses, first OR gate means having a first input terminal coupled to receive said time correction pulses, a second input terminal coupled to receive said standard time signal and an output terminal coupled to an input terminal of one of said motor drive circuit means and said electronic counter means, second OR gate means having a first input terminal for receiving said time correction pulses, a second input terminal coupled to receive said standard time signal, and an output terminal coupled to an input terminal of the other one of said motor drive circuit means and said electronic circuit means, AND gate circuit means having an output terminal coupled to the second input terminal of said second OR gate means, a first input terminal coupled to receive said time correction pulses and a second input terminal, and switch means coupled to the second input terminal of said AND gate means whereby said time correction pulses can be enabled to be applied to said second OR gate means for enabling both said electro-optical display means and said time indicating hands to be set to indicate a desired value of time substantially simultaneously.

* * * * *